US005188049A

United States Patent [19]

Graf

[11] Patent Number: 5,188,049

[45] Date of Patent: Feb. 23, 1993

[54] CATAMARAN BOAT

[76] Inventor: Lawrence J. Graf, 9716 Wall St., Snohomish, Wash. 98290

[21] Appl. No.: 820,991

[22] Filed: Jan. 14, 1992

[51] Int. Cl.[5] ..... B63B 1/12

[52] U.S. Cl. ..... 114/61

[58] Field of Search ..... 114/61, 56, 283, 288

[56] References Cited

U.S. PATENT DOCUMENTS

| | | | |
|---|---|---|---|
| D. 230,316 | 2/1974 | Hull | D71/1 Q |
| D. 290,948 | 7/1987 | Hledin | D12/310 |
| 2,950,701 | 8/1960 | Stefani | 114/61 X |
| 3,016,861 | 1/1962 | Brown | 114/61 |
| 3,046,926 | 7/1962 | Miller | 114/61 |
| 4,389,958 | 6/1983 | March | 114/61 X |
| 4,498,409 | 2/1985 | Edel | 114/283 X |
| 4,543,898 | 10/1985 | Castilla | 114/61 |
| 4,565,145 | 1/1986 | Mayall et al. | 114/61 |
| 4,813,366 | 3/1989 | Elder | 114/61 |
| 4,951,591 | 8/1990 | Coles | 114/274 |

OTHER PUBLICATIONS

Cris-Craft Advertisement, Boating, Oct. 1984, p. 15, "Chris Cat".

*Primary Examiner*—Sherman Basinger

*Attorney, Agent, or Firm*—Christensen, O'Connor, Johnson & Kindness

[57] ABSTRACT

A powered catamaran boat having displacement hulls (10) that provide stable boat performance. The two hulls (10) are joined by a deck structure (12), forming a tunnel (16) between the two hulls. Each of the hulls is symmetric and has a half entry angle ($\theta$) less than 10° at and below the water line, and a length-to-maximum beam ratio at the water line from approximately 9.88:1.0 to 10.92:1.0. The rear portion of each keel extends rearwardly and upwardly from the horizonal at an angle between approximately .80° and 1.4°. The ratio between the minimum vertical distance from the water line to the deck structure and the minimum width of the tunnel (16) is between 1.0:2.0 and 1.0:2.5. Additionally, each hull (10) includes a chine (50) that extends laterally outwardly from the hull a distance from approximately 3% to 6% of the maximum beam (24) of the hull at the water line.

7 Claims, 4 Drawing Sheets

WL
50
12
26
22
10
54
24
1
2
3
4
5
6
7
8
9
10
θ
ψ
β

CATAMARAN BOAT

FIELD OF THE INVENTION

The present invention relates to powered catamaran type boats. Specifically, the invention relates to catamarans which have relatively high speed displacement-type hulls.

BACKGROUND OF THE INVENTION

Traditionally, there are two different philosophies used to design power boats. The first philosophy is to design the power boat with a planing hull, while the second is to design the power boat with a non-planing or displacement-type hull. Planing hulls use a significant amount of horsepower to lift a large part of the hull up on top of the water, thus reducing the wetted surface area and drag. Because of the reduction in wetted surface area, a planing type hull is typically capable of much higher speeds than a comparable non-planing hull. However, because a large portion of the hull is lifted out of the water, the boat tends to skip or bounce over the top of the waves, resulting in a rough, uncomfortable ride. Non-planing or displacement type hulls on the other hand do not lift out of the water, but instead tend to cut through the water. This results in a smoother ride, however, due to the larger wetted surface area and greater wave drag, displacement type hulls typically are not capable of attaining as high of speeds as planing type hulls.

The majority of prior art power boat designs use a single hull, however, a small minority use a double hull or catamaran design. Catamarans have two parallel hulls separated by a deck structure; this design greatly increases the stability of the resulting boat. Because catamarans have two hulls spaced apart, a catamaran is much less susceptible to water disturbances such as wave action. One disadvantage of prior art catamarans is that they tend to splash and spray water up over the top of the deck structure. This is not a problem if the user expects to get wet, such as in a number of sailing catamarans, but it is unacceptable in a powered pleasure craft.

In the past, most boat designs have been available in a limited range of choices. Buyers either had to sacrifice the excitement and enjoyment of having a high-performance power boat in order to obtain a smooth, pleasant ride, or sacrifice a pleasant ride and stability in order to obtain high performance.

SUMMARY OF THE INVENTION

The present invention provides a catamaran which effectively achieves most of the advantages of both planing and displacement hulls without the associated disadvantages. The present invention is characterized by the extreme stability achievable through a catamaran design, while also achieving superior rough water performance without the typical slapping and bouncing present in planing hull designs. The catamaran of the present invention is also capable of reaching speeds of approximately 85% of a typical planing hull design, thus achieving significantly better performance than typical displacement hull designs. In general, hull efficiency is increased over the prior art without sacrificing speed or performance and while increasing the stability and the smoothness of the ride.

In a preferred embodiment of the present invention, each hull has a half entry angle less than 10° and a rearwardly and upwardly sloping rear keel portion that helps to ensure that the hull cuts through the water as opposed to lifting or planing on top of the water. In addition, the catamaran uses a large tunnel designed to minimize drag and resistance due to water flowing through the tunnel at high speeds. Each hull also includes a chine specially designed to increase the hull's lift when entering a wave while allowing the hull to settle quickly upon exiting the wave, thus helping to smooth out the catamaran's ride. The present invention provides an extremely stable boat capable of approximately 85% of the speed of a planing boat with half the rate of fuel consumption of a comparatively sized prior art planing boat.

In accordance with some aspects of the present invention, each hull is symmetric and has a length-to-maximum beam ratio at the water line from approximately 9.9:1.0 to 10.9:1.0. Additionally, the rear keel portion of each hull extends upwardly from the horizontal toward the water line at an angle from approximately .80° to 1.84°. The hulls are separated such that the ratio between the minimum vertical distance from the water line to the deck structure and the minimum width of the tunnel is from approximately 1:2.0 to 1:2.5.

In accordance with other aspects of the invention, the chine extends a distance outwardly from the hull from approximately 3% to 6% of the maximum beam of the hull at the water line. Additionally, the tip of the bow of each hull extends at an angle from approximately 20° to 30° with respect to the vertical.

BRIEF DESCRIPTION OF THE DRAWINGS

The foregoing aspects and many of the attendant advantages of this invention will be readily appreciated as the same becomes better understood by reference to the following detailed description, when taken in conjunction with the accompanying drawings, wherein.

DETAILED DESCRIPTION OF THE PREFERRED EMBODIMENT

Figures 1, 2:
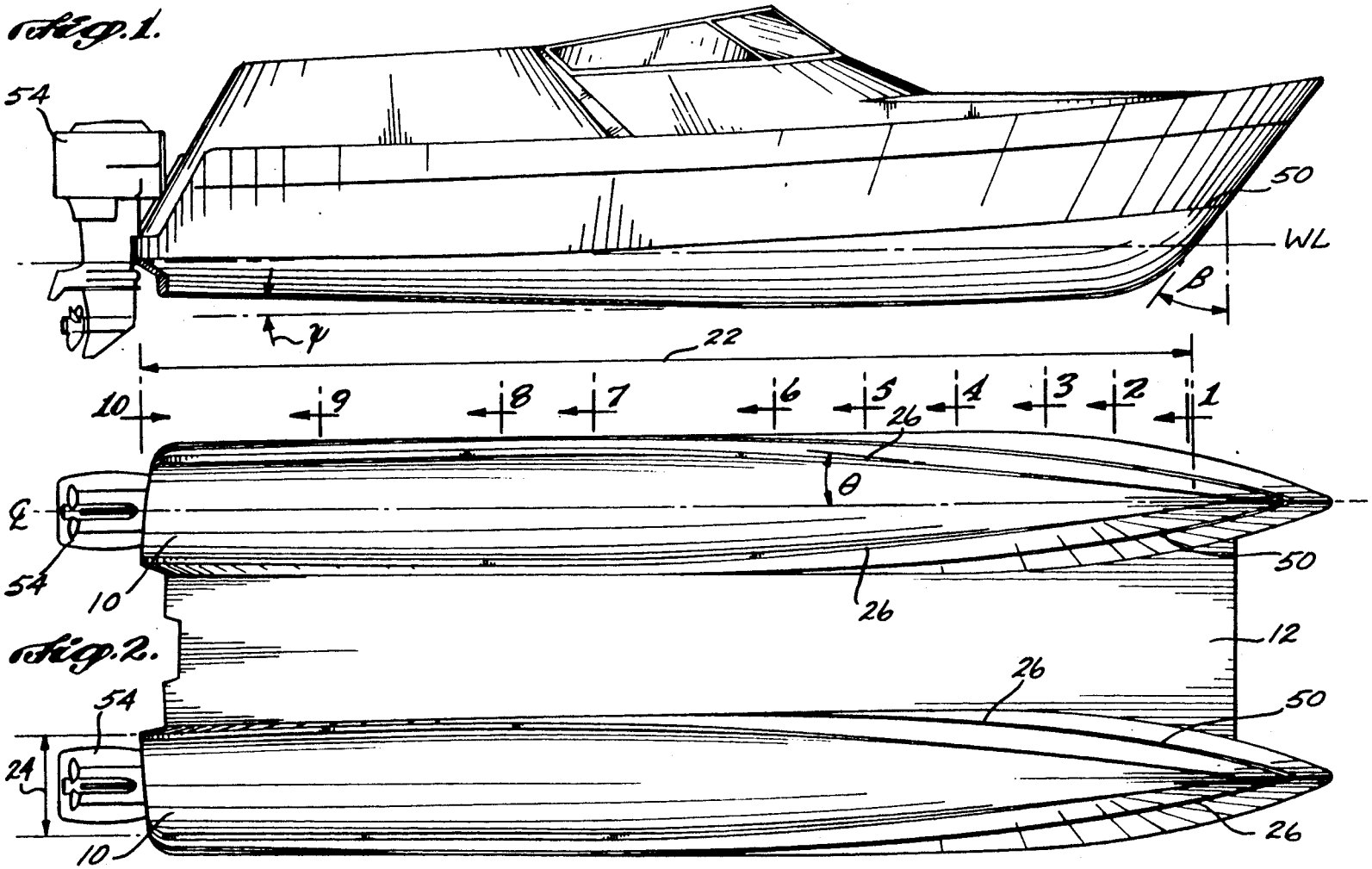
FIG. 1 is a side elevational view of a preferred embodiment of a catamaran boat of the present invention.
FIG. 2 is a bottom plan view of the catamaran boat of FIG. 1.
Figure 3:
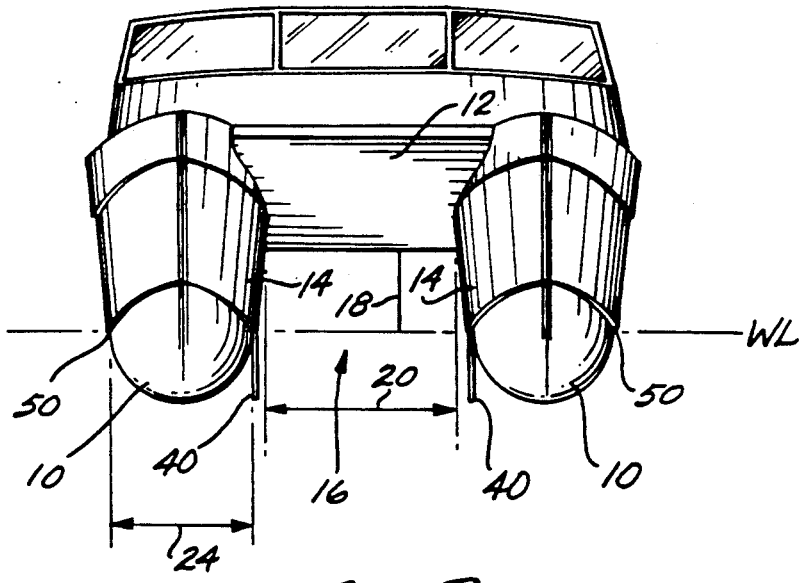
FIG. 3 is a front elevational view of the catamaran boat of FIG. 1.

Referring initially to FIGS. 1–3, a preferred embodiment of a catamaran boat of the present invention is disclosed. As shown, the boat has two hulls 10 separated by a deck structure 12. In order to define the geometric characteristics of the catamaran, a water line (WL) is shown in FIGS. 1 and 3. The water line defines the extent to which the boat displaces water when loaded to the design weight.

As illustrated in FIG. 3, the lower surface of the deck structure 12, the inward sides 14 of the hulls and the WL define a tunnel 16 extending longitudinally between the two hulls. In order to achieve the advantages of the present invention, it is beneficial to design the boat such that the height 18 of the tunnel and the width 20 of the tunnel are properly dimensioned. As shown, the height of the tunnel is the vertical distance between the lower surface of the deck structure 12 and the WL, while the width of the tunnel is the distance between the inward sides 14 of the hulls, i.e., where the sides connect to the deck.

As the catamaran moves through the water at high speed, the two hulls 10 funnel a significant volume of water through the tunnel 16. If the tunnel 16 is of sufficient cross-sectional area, the water is allowed to flow freely through the tunnel, thus reducing drag and increasing performance. On the other hand, if the width 20 of the tunnel is too small, the water flowing through the tunnel becomes highly turbulent and can be forced up the inward sides 14 and possibly into contact with the deck structure 12, thus increasing drag. Furthermore, if the height-to-width ratio of the tunnel is improper, in rougher water, waves tend to slap against the deck structure 12 and inward sides 14 of the hulls, thereby increasing drag and increasing the noise level and roughness of the ride. In addition to increasing drag and noise, an improperly sized tunnel can result in the oncoming waves being broken by the deck structure 12 which results in water splashing over the top of the deck structure and possibly into the interior of the boat.

It is believed that an appropriate ratio of the height-to-minimum width of the tunnel 16 is from approximately 1.0:1.5 to 1.0:3.0, while a more optimum height-to-width ratio of the tunnel is from approximately 1:2.0 to 1:2.5. For the preferred embodiment shown, the most optimum height-to-width ratio was found to be approximately 1.0:2.27.

In addition to the tunnel design, it is advantageous to properly design each hull in order to achieve the benefits of the present invention. One of the factors that influences the lifting, drag, and ride of the hull is the angle $\beta$ (FIG. 1) at which the bow of the hull inclines rearwardly and downwardly with respect to the vertical. If the angle $\beta$ is too large, the bow of the boat could lift or plane as the bow moves through oncoming waves. It is believed that an acceptable range for the angle $\beta$ is from about 0° to 35°, while a more desirable range for the angle $\beta$ is between approximately 20° and 30°. In the preferred embodiment shown, the value of the angle $\beta$ is optimally approximately 25°.

In addition to the angle $\beta$, the keel is at a maximum depth substantially the entire length of the hull including forwardly to almost the bow of the hull. This helps to ensure that the bow cuts through the oncoming water at high speeds as opposed to being lifted out of the water by oncoming waves.

The half-entry angle $\theta$ is also important to achieving the benefits of the present invention. As shown in FIG. 2, the half-entry angle $\theta$ is the angle at which the sides 26 of the hulls 10 extend rearwardly from the bow with respect to the center line of the hull as measured at the waterline. A desirable half-entry angle $\theta$ allows the hull to cut through the water without significantly disturbing the water. This helps to ensure that smooth flow is maintained over most of the length of the hull, thus reducing drag and increasing efficiency. A small half-entry angle also decreases drag caused by the creation of waves as the hull moves through the water. Furthermore, a small half-entry angle $\theta$ allows the bow of the hull to cut cleanly through the water without creating any appreciable lift on the forward section of the hull. This helps to ensure that the hull remains a displacement-type hull and does not begin planing at high speeds. In addition, a small half-entry angle $\theta$ allows the hull to cut easily through the water, thus decreasing the effect of waves on the hull, resulting in increased stability and a smoother ride. It is believed that an acceptable half-entry angle $\theta$ is from approximately 5° to 12°; however, the optimum performance is achieved with a half-entry angle $\theta$ of between approximately 6.5° to 8.5°. In the preferred embodiment shown, the most optimum half-entry angle $\theta$ is approximately 7.5°.

Another factor that influences the drag, ride and maximum attainable speed of the boat is the ratio of the length of the hull to the maximum beam of the hull. The lengths 22 (FIG. 2) of the hulls 10 and maximum beams 24 (FIG. 3) of the hulls 10 are defined as the length of the hull and the maximum beam of the hull at the WL when the boat is at the design weight. The length-to-beam ratio of the hull can influence the water's flow over the length of the hull thus affecting the point at which the flow becomes turbulent. Turbulent flow over the hull increases the drag of the hull thus decreasing performance. Additionally, the length-to-width ratio of the hull influences the size of waves produced along the sides and at the rear of the boat also affecting the drag. It is believed that an acceptable length-to-beam ratio of the hull is from approximately 9:1 to 12:1, while the best hull performance is achieved with a length-to-beam ratio of between approximately 9.88:1.0 and 10.92:1.0. In the preferred embodiment shown, the most optimum length-to-beam ratio is 10.4:1.0. In the preferred embodiment shown, the maximum beam of each hull at the water line is located at from approximately 65% to 75% along the length of the hull at the water line as defined from the bow of the hull.

The long, narrow hull and low half-entry angle used in the preferred embodiment of the present invention has been found to increase hull efficiency. The resulting water flow around the hulls at high speeds illustrates this fact. At approximately 25 miles per hour, the preferred embodiment shown produces a wave pattern which slips off the transom, at approximately 11° with respect to the centerline of the boat and has a wave height of approximately 5 inches. Similar single-hull prior art boats of the same displacement and length produce a wave pattern which breaks away amidships at approximately 20° and has a wave height of approximately 15–18 inches. This illustrates that the hull design of the present invention maintains smooth flow substantially along the length of the hull and reduces the size of the waves and thus the amount of drag produced as the hull moves through the water. This is further evidenced by the fact that in the preferred embodiment, the fuel consumption rate is approximately one-half of that of prior art boats of similar displacement and engine size.

Another important aspect of the hull design of the present invention is the angle at which the rear of the keel extends rearwardly toward the stern and upwardly toward the WL. As shown in FIG. 1, the rear portion of the keel is inclined upwardly with respect to the horizontal at an angle $\Psi$. An improperly determined keel angle $\Psi$ can cause the hull to plane at high speeds, thus decreasing efficiency and degrading ride quality. It is believed that an acceptable range of values for the angle Ψ is from approximately 0.60° to 2.0°. Experimental tests have shown that the optimum range of values for the angle Ψ are from approximately 0.80° to 1.84°. In the preferred embodiment shown, the most optimum value of Ψ is approximately 1.6°.

In addition to optimizing the value of the angle Ψ, it is also beneficial to optimize the location at which the keel begins to incline upward. This also helps to ensure that the hull does not plane at higher speeds. An optimum range of distances at which the rear portion of the keel should begin to incline upward is from approximately 30% to 42% of the WL length of the hull, as defined from the bow of the hull at the WL. In the preferred embodiment of the present invention shown, the keel inclines upward beginning at approximately 37–39% of the WL length of the hull, as defined from the bow of the hull at the WL.

Figure 4:
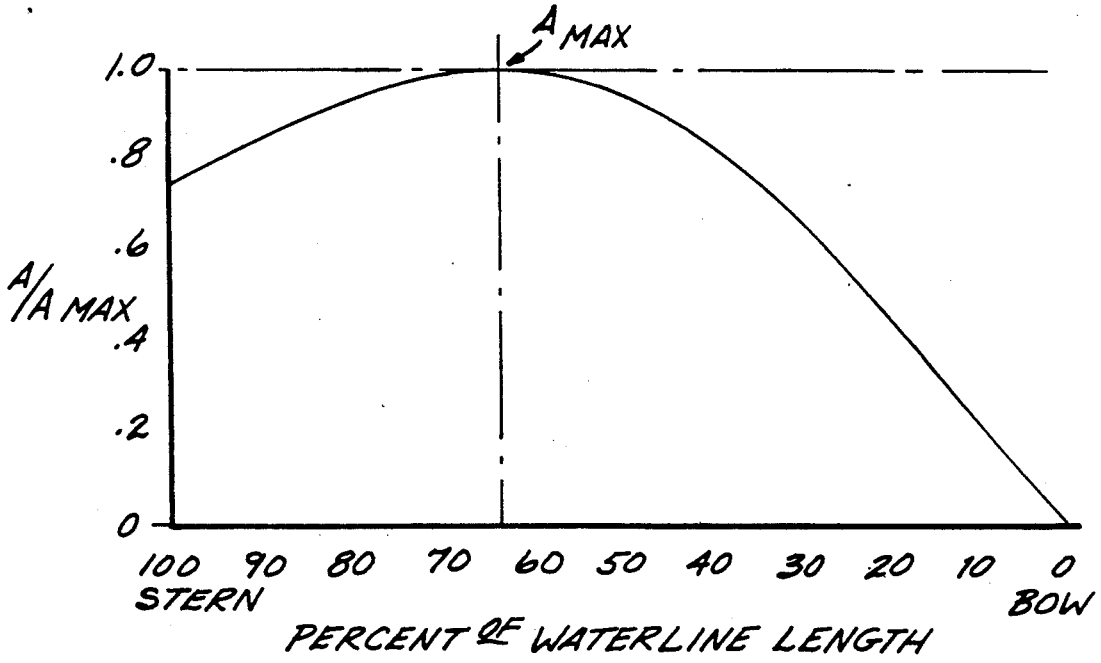
FIG. 4 is a graph of the underwater cross-sectional area of one of the hulls of the catamaran of FIG. 1, where the percent of the water line shown along the x-axis and the normalized cross-sectional area is shown along the y-axis.

FIG. 4 is a graph of the underwater cross-sectional area of one of the hulls of the preferred embodiment. The percent of the length of the hull at the WL is shown along the x-axis, starting at 100% which is at the stern of the boat and decreasing to 0% which is at the bow of the boat. A normalized cross-sectional area is shown along the y-axis. The normalized cross-sectional area is the cross-sectional area of the hull below the WL normalized by dividing by the maximum cross-sectional area. As shown, the normalized cross-sectional area of the bow starts at 0 and increases approximately linearly in the rearward direction for about 40% of the length of the hull. The normalized cross-sectional area then transitions smoothly to a maximum at a location about 63% rearward from the bow and then decreases smoothly to a location at approximately 80% rearward from the bow, at which point it then decreases approximately linearly to about 75% of the maximum cross-sectional area. The maximum beam is at a location along the hull WL approximately 68% of the distance rearward from the bow.

It is believed that gradual increasing and then decreasing cross-sectional area over the length of the hull helps increase efficiency. As the hull moves through the water, the slowly increasing cross-sectional area helps to gradually open an envelope in the water and then the decreasing cross-sectional area helps to slowly close the envelope at the stern of the hull. This helps to maintain smooth flow along the length of the hull. This also decreases turbulent flow along the sides of the hull and in the tunnel, thus helping to decrease drag and increase efficiency. Additionally, the increasing and then decreasing cross-sectional area helps reduce the size of the wake produced at the stern of the boat, also reducing drag and increasing efficiency.

Figure 5:
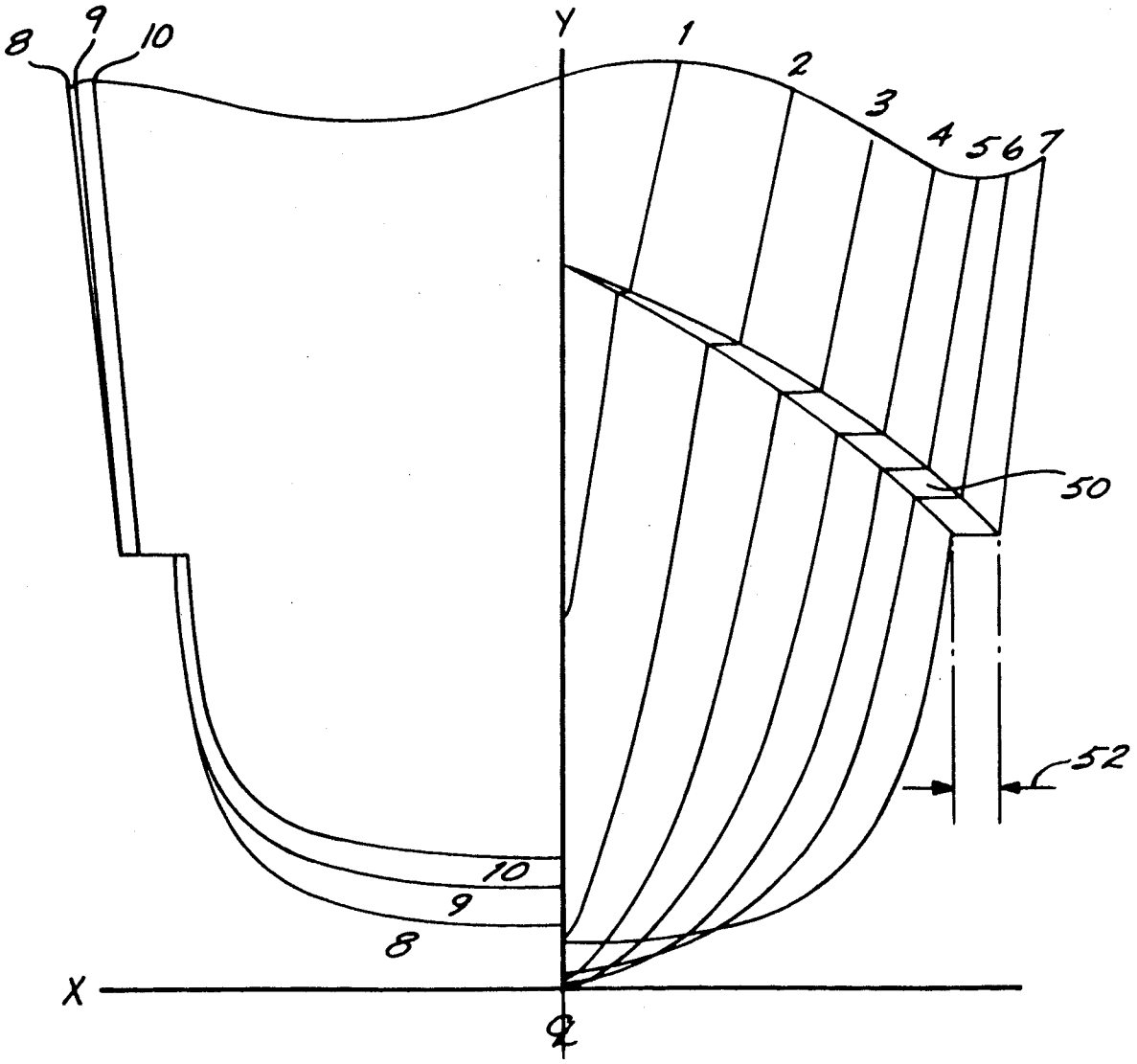
FIG. 5 illustrates a series of partial cross sections of the hull of the catamaran of FIG. 1 at the locations indicated in FIG. 2.

FIG. 5 illustrates a series of partial cross sections of the bottom portion of one of the hulls 10 at the locations along the length of the hull indicated in FIG. 2. The vertical depth of the hull is shown along the y-axis while the beam of the hull is shown along the x-axis. Furthermore, the right half of the graph shows hull cross sections (1 through 7) from the bow of the hull while the left half of the graph shows cross sections (8 through 10) from the stern of the hull. The hulls are symmetrical, therefore, it is only necessary to show one-half of the hull in order to fully define the hull dimensions.

As depicted in FIG. 5, the hull begins with a narrow, highly tapered cross-sectional area as shown by cross section 1. The beam and depth of the hull then progressively increase as shown by the successive cross sections. As the cross sections are taken further and further back along the length of the hull, the radius of curvature of the bottom of each section becomes larger until the bottom of the hull has only a slight curve to it, as illustrated by cross section 10. In the preferred embodiment shown, the bottom of the hull is never totally flat, however, in alternate embodiments of the present invention, the hull bottom could be constructed of flat surfaces which would result in a hull with a flat bottom and a less smooth exterior surface. A hull formed of flat surfaces is not as efficient as a smoothly transitioning hull, but the cost of building such a hull may be less.

As described above, the beam shape of the bottom of each hull of the preferred embodiment shown is curved over the entire length of the hull. This curved shape may tend to decrease the ability of the boat to track truly in a straight line. Therefore, it could be advantageous to place tracking fins 40 (FIG. 3) on the hulls 10. The tracking fins could be constructed as flat plates extending from the sides or bottoms of the hulls to increase directional stability and control of the boat.

Another advantageous feature of the present invention is the use of a chine 50, such as shown in FIGS. 1–3 and 5. In the present invention, the chine is a surface which extends laterally outwardly from the sides of the hull. In the preferred embodiment of the present invention, the chine extends parallel to the WL; however, the chine could also slope upwardly or downwardly from the WL. A typical range of angles at which the chine could extend from the hull with respect to the vertical is from approximately 70° to 120°. As the catamaran enters a wave, the chine presents an enlarged cross-sectional area to the oncoming wave. This increases the lift or buoyancy of the boat in an oncoming wave. Once through the wave, the hull quickly settles into the water up to the chine 50 at which point the chine increases the hulls lift once again. This function of the chine helps to smooth the hulls movement through oncoming waves.

As an analogy, the chine could be considered as a damper which damps out the up and down and side to side movement of the hull as the boat moves through the water. The damping effect of the chine increases the stability of the hull through rough water while also smoothing out the ride. It is beneficial to extend the chine outward from the sides of the boat to a distance 52, FIG. 5. The distance 52 is defined as the horizontal distance that the outer edge of the chine extends from the side of the boat. The optimum performance is achieved when the distance 52 is from approximately 3% to 12.5% of the maximum beam of the hull at the WL. Applicants have found that in the preferred embodiment shown, the most optimum performance is achieved when the distance 52 is approximately 6% of the maximum beam of the hull.

Besides helping to damp the motion of the boat, the chine serves other purposes. As shown in FIG. 1, the chine extends parallel to the water line along the rear half of the boat and gradually rises upwardly above the water line over the front half of the boat. As the boat moves through the water, the waves tend to roll up the forward section of the hull. The elevated chine acts to curl these bow waves over and outwardly away from the hull, thus decreasing the amount of water sprayed onto the deck of the boat. This is important in catamaran-type designs; prior art catamarans tend to be wet due to the spray created by the multiple-hull design. In addition to reducing spray, the chine also provides additional stiffness to the hull structure.

The preferred embodiment of the present invention can be powered by any of a number of motor arrangements. The arrangement shown in FIG. 1 consists of twin outboard motors 54 mounted at the stern of the boat, one outboard motor behind each hull 10. Appropriate motor mountings are provided for the motors 54. It is advantageous to use two outboard motors so that each outboard motor can be individually operated and pivoted, thus increasing the ability to maneuver and control the boat. In alternate embodiments (not shown) inboard motors mounted within each hull 10 could be used instead of the outboard motors 54 shown in FIG. 1.

Figure 6:
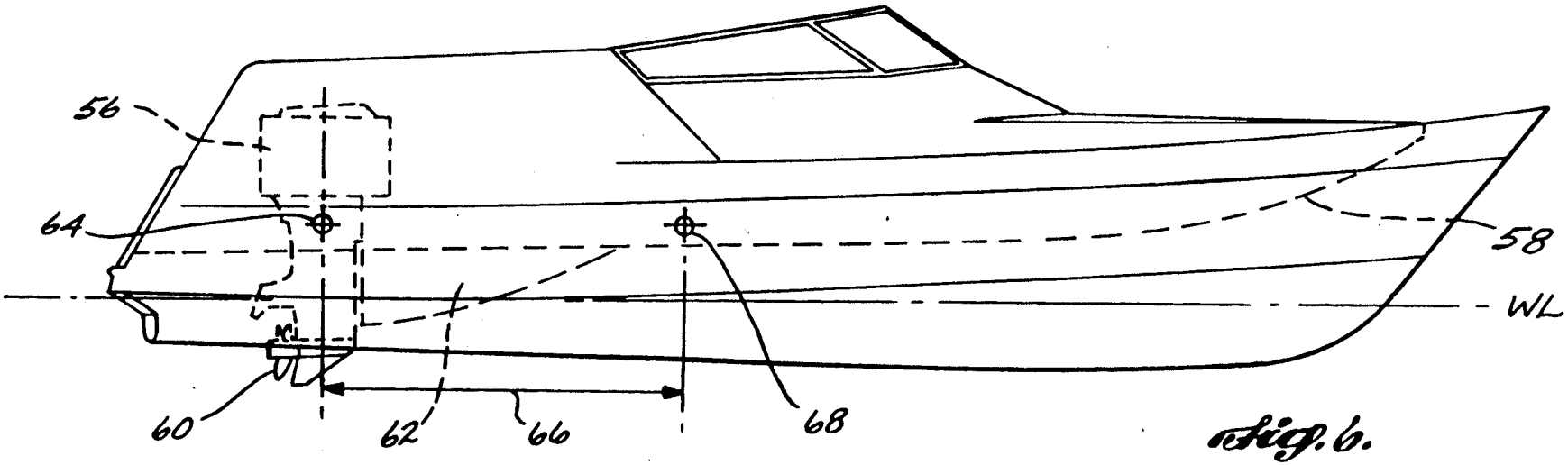
FIG. 6 is a side elevational view of a second embodiment of the present invention; and, FIG. 7 is a front elevational view of the embodiment of FIG. 6.
Figure 7:
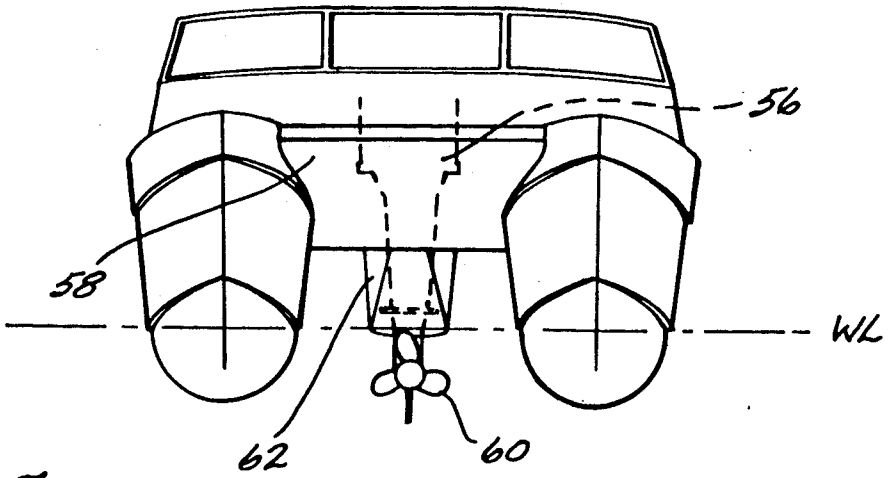

FIGS. 6 and 7 show a second embodiment of the present invention characterized by an outboard motor 56 (shown in phantom line) mounted forward from the stern of the boat. Mounting the outboard motor forward from the stern of the boat decreases the moment arm created by the driving force of the motor acting about the center of buoyancy of the boat. This reduction in moment arm helps to smooth out the overall ride of the boat. The motor 56 is located between the two hulls and extends out the bottom of the deck structure 58 such that the propeller 60 is located below the WL. In order to reduce drag, it is advantageous to place a shroud 62 in front of and over the outboard motor 56. The shroud extends downward and rearward from the bottom surface of the deck to partially enclose the lower forward portion of the outboard motor. The shape of the shroud should be carefully tailored so that it cuts easily through the oncoming water and does not increase drag. Optimum results for the second embodiment are achieved by locating the motor such that the center of gravity 64 of the motor is located a distance 66 from approximately 15% to 30% of the WL length of the hull rearwardly from the center of buoyancy 68 of the boat.

Other than as described, the boat construction shown in FIGS. 6 and 7 is ideally the same as the boat construction shown in FIGS. 1-5. thus, the foregoing description of the boat shown in FIGS. 1-5 all applies to the boat shown in FIGS. 6 and 7.

As an illustrative but not limiting example, the boat shown in FIGS. 1-7 could be constructed with a hull having a WL length of 20'8", a maximum hull beam at the WL of 24", a tunnel height of 16", and a width of 36". With a single 90 HP motor at design weight, a boat having these dimensions would weigh approximately 2,700 pounds, have a wetted surface area of approximately 110 square feet and achieve a top speed of approximately 25 mph. In order to demonstrate that the hull design of the present invention is a non-planing, displacement-type hull, the wetted surface area of the hull with the above specifications was measured at rest and at a cruising speed of 25 miles per hour. The ratio of the wetted surface area at cruising speed versus at rest is approximately 0.98:1.0. This ratio establishes that the hull design of the preferred embodiment is a displacement hull. For a planing hull this ratio would be much smaller, perhaps about 0.40:1.0. These specifications would change depending upon the size of the boat, design weight, design application, etc.

As discussed above, to achieve the advantages of the present invention it may be desirable to vary the height-to-width ratio of the tunnel 16, the half angle $\theta$ of the hull, the keel angle $\Psi$, the length-to-width ratio of the hull, the location and width of the chine, etc. It is believed that no one of these factors is solely responsible for the advantages achieved by the present invention. However, it is the combined result of the individual unique features of the present invention which achieves the overall advantages of an extremely stable, smooth riding catamaran hull construction. The resulting boat is capable of cleanly cutting through the water as opposed to bouncing or skipping over the top of the waves. This results in a boat capable of reaching approximately the performance of a planing-type boat without the attendant rough ride, high-power requirement and other disadvantages of a planing boat.

While the preferred embodiments of the invention have been illustrated and described, it will be appreciated that various changes can be made therein without departing from the spirit and scope of the invention.

The embodiments of the invention in which an exclusive property or privilege is claimed are defined as follows:

1. A powered catamaran boat which displaces water up to a water line when at design load in a body of water, the boat comprising two symmetric, nonplaning, displacement hulls connected together with a deck structure forming a tunnel between the hulls, the ratio of the minimum distance from the water line to the bottom of the deck structure to the minimum width of the tunnel being between approximately 1.0:2.0 to 1.0:2.5, each hull having first and second sides connected so as to form a bow having a half angle of between approximately 5° to 12° at and below the water line, and each hull having a ratio of the length of each hull at the water line to the maximum beam of each hull at the water line between approximately 9.88:1.0 and 10.92:1.0.

2. The boat as claimed in claim 1, wherein the maximum beam of each hull at the water line is located at from approximately 65% to 75% along the length of the hull at the water line as defined from the bow of the hull.

3. The boat as claimed in claim 1, wherein the half angle of each hull at the water line is from approximately 6.5° to 8.5°.

4. The boat as claimed in claim 1, wherein a rear portion of the keel of each hull extends upwardly toward the water line and rearwardly toward the stern of the boat at an angle between approximately 0.80° and 1.84° with respect to the horizontal.

5. The boat as claimed in claim 1, wherein each hull further includes a chine extending along the length of the hull and laterally outwardly from the hull to a distance from approximately 3% to 12.5% of the maximum beam of the hull at the water line.

6. The boat as claimed in claim 1, wherein the tip of the bow of the boat extends downwardly and rearwardly at an angle from approximately 20° to 30° to the vertical.

7. The boat as claimed in claim 1, wherein the boat further comprises motor mounting means for mounting a motor to the boat such that the center of gravity of the motor is located between the two hulls from approximately 15% to 30% of the length of each hull at the water line rearward from the center of buoyancy of the boat.

* * * * *

UNITED STATES PATENT AND TRADEMARK OFFICE

CERTIFICATE OF CORRECTION

PATENT NO. : 5,188,049

DATED : February 23, 1993

INVENTOR(S) : L. J. Graf

It is certified that error appears in the above-identified patent and that said Letters Patent is hereby corrected as shown below:

| COLUMN | LINE | |
|---|---|---|
| [56] "Other | 2nd Publn. Publns." | add --Manta Power Catamarans advertisement brochure (4 pages), undated.-- |
| [56] "Other | 3rd Publn. Publns." | add --"Here Come the CATS!", 56 *Salt Water Sportsman*, March 1992.-- |
| [57] "Abstract" | 14 | after "between" insert --approximately-- |
| 2 | 47 | after "line" insert --length is-- |
| 7 | 39 | "thus," should read --Thus,-- |

Signed and Sealed this

Sixteenth Day of November, 1993

*Attest:*

*Attesting Officer*

Bruce Lehman

BRUCE LEHMAN

*Commissioner of Patents and Trademarks*